US011486086B2

(12) United States Patent
Gao et al.

(10) Patent No.: US 11,486,086 B2
(45) Date of Patent: Nov. 1, 2022

(54) SELF-FUSED GRAPHENE FIBER AND METHOD OF PREPARING THE SAME

(71) Applicant: ZHEJIANG UNIVERSITY, Hangzhou (CN)

(72) Inventors: Chao Gao, Hangzhou (CN); Dan Chang, Hangzhou (CN); Zheng Li, Hangzhou (CN); Weiwei Gao, Hangzhou (CN)

(73) Assignee: ZHEJIANG UNIVERSITY, Hangzhou (CN)

( * ) Notice: Subject to any disclaimer, the term of this patent is extended or adjusted under 35 U.S.C. 154(b) by 466 days.

(21) Appl. No.: 16/476,121

(22) PCT Filed: Feb. 27, 2018

(86) PCT No.: PCT/CN2018/077303

§ 371 (c)(1),
(2) Date: Jul. 5, 2019

(87) PCT Pub. No.: WO2018/196475

PCT Pub. Date: Nov. 1, 2018

(65) Prior Publication Data

US 2020/0040519 A1 Feb. 6, 2020

(30) Foreign Application Priority Data

Apr. 28, 2017 (CN) ..... 201710294377.6

(51) Int. Cl.
*D06M 11/80* (2006.01)
*D01D 5/04* (2006.01)
(Continued)

(52) U.S. Cl.
CPC ..... *D06M 11/80* (2013.01); *D01D 5/04* (2013.01); *D01D 5/06* (2013.01); *D01D 10/06* (2013.01);
(Continued)

(58) Field of Classification Search
CPC ..... D06M 11/80
See application file for complete search history.

(56) References Cited

U.S. PATENT DOCUMENTS

2014/0315460 A1* 10/2014 Muramatsu ..... C09K 5/14 423/447.2
2015/0329761 A1* 11/2015 Grujicic ..... B29C 70/025 427/560
2017/0154703 A1* 6/2017 Lonjon ..... B29C 70/882

FOREIGN PATENT DOCUMENTS

CN 105586646 A 5/2016
CN 105671689 A 6/2016
(Continued)

OTHER PUBLICATIONS

"Programmable Writing of Graphene Oxide Reduced Graphene Oxide Fibers for Sensible Networks with in Situ Welded Junctions" Cao, J. et al. [Apr. 7, 2014].
(Continued)

*Primary Examiner* — Andrew T Piziali
(74) *Attorney, Agent, or Firm* — W&G Law Group

(57) ABSTRACT

Disclosed in the present disclosure are a self-fused graphene fiber and a method of preparing the same. Dried graphene oxide fibers are soaked in a solvent to swell and then the fibers are pulled out and coalesced. After being dried, the graphene oxide fibers are fused together, and then are further reduced to obtain a self-fused graphene fiber. The entire self-fusion process can be quickly finished within one minute without adding any additional binder. The operation is simple and time-saving. The process is environmentally friendly; the bond strength is high, and the excellent properties such as outstanding mechanical strength and electrical conductivity of the graphene fibers themselves can be maintained. The present disclosure has great research and application value for further preparation of two-dimensional graphene fabrics or three-dimensional network bulks with excellent performance.

6 Claims, 2 Drawing Sheets

(51) Int. Cl.

| | |
|---|---|
| ***D01D 5/06*** | (2006.01) |
| ***D01D 10/06*** | (2006.01) |
| ***D06M 11/05*** | (2006.01) |
| ***D06M 11/13*** | (2006.01) |
| ***D06M 11/63*** | (2006.01) |
| *D06M 101/40* | (2006.01) |

(52) U.S. Cl.
CPC ..... *D06M 11/05* (2013.01); *D06M 11/13* (2013.01); *D06M 11/63* (2013.01); *D06M 2101/40* (2013.01)

(56) References Cited

FOREIGN PATENT DOCUMENTS

| | | | |
|---|---|---|---|
| CN | 106120025 | A | 11/2016 |
| CN | 106702535 | A | 5/2017 |
| CN | 106948165 | A | 7/2017 |

OTHER PUBLICATIONS

"Structure Regulation and Application of Carbon Nanomaterials, Science-Engineering(A) China Master's Theses Full-Text Database" Xiang, Xi [Feb. 15, 2017].
International Search Report (PCT/CN2018/077303); dated Feb. 27, 2018.

* cited by examiner

SELF-FUSED GRAPHENE FIBER AND METHOD OF PREPARING THE SAME

TECHNICAL FIELD

The present disclosure relates to a graphene fiber, in particular to a self-fused graphene fiber and a method of preparing the same.

BACKGROUND

Graphene is a type of allotrope of carbon with a single atomic layer thickness which has low density, extremely high mechanical strength, thermal conductivity and electrical conductivity, and has attracted widespread attention since it was reported by Geim et al. in 2004 (Science, 2004, 306: 666-669). A graphene fiber is an one-dimensional macro assembly integrated by graphene sheets and possesses properties of light weight, high thermal conductivity and electrical conductivity due to the excellent properties of the graphene itself. The current method for obtaining a thick graphene fiber is generally performed by spinning using a large-diameter nozzle (Accounts of chemical research, 2014, 47(4): 1267-1276) or by integrating finer graphene fibers into a yarn (Acta Astronautica, 2013, 82(2): 221-224). Due to the technique deficiencies, there is always large difference between the internal and external structures of the graphene fiber when spinning using the large-diameter nozzle, thereby making it difficult to obtain a thick graphene fiber having excellent properties. When finer graphene fibers are integrated into a yarn, the superiority of the graphene fibers themselves cannot be sufficiently exhibited in the yarn due to the weak interaction among the fibers.

The present disclosure utilizes the swelling of graphene fibers in a solvent to achieve rapid fusion between fibers, thereby obtaining a self-fused graphene fiber with an increased diameter. Compared with the raw graphene fibers, the self-fused graphene fiber has a larger diameter and can maintain the advanced functionalities such as the excellent electrical conductivity of the raw graphene fibers themselves. Since a plurality of graphene fibers coalesce side by side and are fused during preparation, the surface of the self-fused graphene fiber has axial grooves, resulting in a large specific surface area, which is beneficial to make further functional modification to the fiber and increase the loading of the modifier. Moreover, the self-fused method does not require addition of additional binder and is simple in operation, time-saving, environmentally friendly and of high bonding strength.

SUMMARY

Existing preparation method of thick graphene fibers is generally performed by spinning with a large-diameter nozzle or by integrating finer graphene fibers into a yarn. When spinning with a large-diameter nozzle, there is always large difference between the internal and external structures of the graphene fiber, thereby making it difficult to obtain a thick graphene fiber having excellent properties. When finer graphene fibers are integrated into a yarn, the superiority of the fibers themselves cannot be sufficiently exhibited due to the weak interaction among the fibers in the yarn. In view of these problems, the present disclosure provides a self-fused graphene fiber having a large diameter and a method of preparing the same.

The object of the present disclosure is achieved by the following aspects. A self-fused graphene fiber is provided.

The self-fused graphene fiber has a diameter that is greater than or equal to 1 μm and is prepared by fusion of a plurality of graphene fibers, with the graphene sheets arranged along the axis, an interlayer spacing of graphene sheets being smaller than or equal to 1 nm, and a density being greater than or equal to 0.8 g/cm$^3$. The surface of the fiber has axial grooves.

Further, the self-fused graphene fiber has a diameter that is greater than or equal to 100 μm.

Further, the self-fused graphene fiber has a diameter that is greater than or equal to 1000 μm.

A method of preparing a self-fused graphene fiber is provided. The method includes steps of:

(1) vacuum drying graphene oxide fibers;

(2) soaking the dried fibers in a solvent in such a manner that the fibers are fully infiltrated and swelled;

(3) pulling out two or more fibers simultaneously from the solvent, the fibers being coalesced at the solvent-air interface under the surface tension of the solvent;

(4) performing reduction after the coalesced fibers are dried so as to obtain a self-fused graphene fiber with excellent properties.

Further, the graphene oxide fibers in the step (1) are prepared by dry or wet spinning; a solvent of a spinning dope is water, N,N-dimethylformamide, N,N-dimethylacetamide, tetrahydrofuran, dimethyl sulfoxide, N-methyl pyrrolidone, ethylene glycol, diethylene glycol, pyridine, ethyl acetate, dioxane, butanone, or isopropanol; a coagulation bath for the wet spinning is a methanol solution of sodium hydroxide, an ethanol solution of sodium hydroxide, a methanol solution of potassium hydroxide, an ethanol solution of potassium hydroxide, an aqueous solution of sodium hydroxide, an aqueous solution of sodium sulfate, an aqueous solution of sodium chloride, an aqueous solution of calcium chloride, an aqueous solution of sodium nitrate, an aqueous solution of calcium nitrate, an aqueous solution of sodium phosphate, an aqueous solution of potassium chloride, an aqueous solution of ammonium chloride, aqueous ammonia, anhydrous diethyl ether, ethanol, ethyl acetate, acetone, or a mixture of these solutions.

Further, the temperature for the vacuum drying is in the range of room temperature to 100° C., and a duration for the vacuum drying is in the range of 1 to 10 hours.

Further, the solvent in the step (2) is: water, alcohol such as methanol, ethanol, isopropanol, ethylene glycol, glycerol, diethylene glycol and the like, organic acid such as formic acid, acetic acid, propionic acid, butyric acid, valeric acid, oxalic acid, malonic acid, succinic acid, acrylic acid and the like, acetone, butanone, N,N-dimethylformamide, N,N-dimethylacetamide, tetrahydrofuran, dimethyl sulfoxide, N-methyl pyrrolidone, pyridine, dioxane, an aqueous solution of sodium chloride, an aqueous solution of calcium chloride, an aqueous solution of sodium nitrate, an aqueous solution of calcium nitrate, an aqueous solution of sodium phosphate, an aqueous solution of potassium chloride, an aqueous solution of ammonium chloride, an aqueous solution of potassium hydroxide, an aqueous solution of sodium hydroxide, or a mixture of these solutions.

Further, a duration for soaking in the solvent is greater than or equal to 0.1 second.

Further, the reduction method is a reduction carried out using a chemical reducing agent, such as hydriodic acid, hydrazine hydrate, vitamin C, sodium borohydride and the like, or a thermal reduction at 100 to 3000° C.

Compared with the related art, the present disclosure has the following advantages:

(1) The present disclosure achieves mutual fusion of the graphene oxide fibers by swelling of themselves, and this method is simple and time-saving, in addition, the applied solvent is environmentally friendly and widely available. This fusion method has great application value.

(2) The diameter of the graphene fiber can be arbitrarily increased by this preparation method and the excellent properties of the graphene fibers themselves can be maintained. The self-fused graphene fiber has a larger diameter, and there is almost no difference between the internal and external structures, making it possible to maintain the excellent mechanical properties and advanced functionalities such as outstanding electrical and thermal conductivities of the raw graphene fibers.

(3) The surface of the self-fused graphene fiber has axial grooves, resulting in a large specific surface area, which is advantageous for making further functional modification to the fiber and increasing the loading of the modifier.

(4) The bonding strength is high. The graphene fibers do not separate during stretching process after self-fusion and do not disperse when re-soaked in the solvent.

BRIEF DESCRIPTION OF DRAWINGS

FIG. 1 shows that internal and external structures of self-fused graphene fiber are relatively homogeneous.

FIG. 2 shows that the constituent graphene fibers are well self-fused.

DESCRIPTION OF EMBODIMENTS

The present disclosure discloses a self-fused graphene fiber and a method of preparing the same. The mutual fusion of the graphene fibers is achieved by the swelling of themselves, so as to obtain a self-fused graphene fiber having an increased diameter. Compared with the thick fibers obtained by other methods, the thick fiber obtained by this fusion method is more homogeneous in the internal and external structures as well as the interlayer spacing, furthermore, the advanced functionalities such as the excellent mechanical properties and electrical as well as thermal conductivities of the raw graphene fibers are maintained.

In order to achieve the fusion of the graphene fibers, the present disclosure re-soaks the graphene oxide fibers obtained by wet spinning in a solvent so as to enable the fibers to be infiltrated and swelled, such that the graphene sheets of the fibers have a slight freedom of motion, and the sheet re-arrangement and mutual fusion of the fibers at the contacting interfaces can be achieved after the fibers coalesce. The fibers are bonded by strong π-π interactions and the resulting self-fused graphene fiber maintains the excellent properties such as electrical and thermal conductivities and the like of raw graphene fibers, thereby solving the technical problems such as a large difference between internal and external structures of the thick fibers or poor fiber performance caused by weak interaction among the fibers in a yarn, which have great practical application value.

Figure 1:
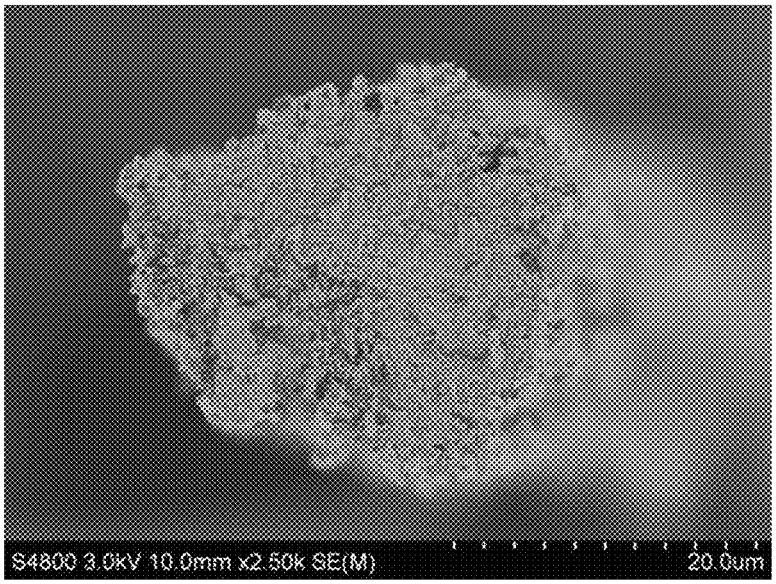
FIG. 1 and FIG. 2 are scanning electron microscopy images of a cross section and a lateral surface of the self-fused fiber prepared by self-fusion of 10 graphene fibers respectively.
Figure 2:
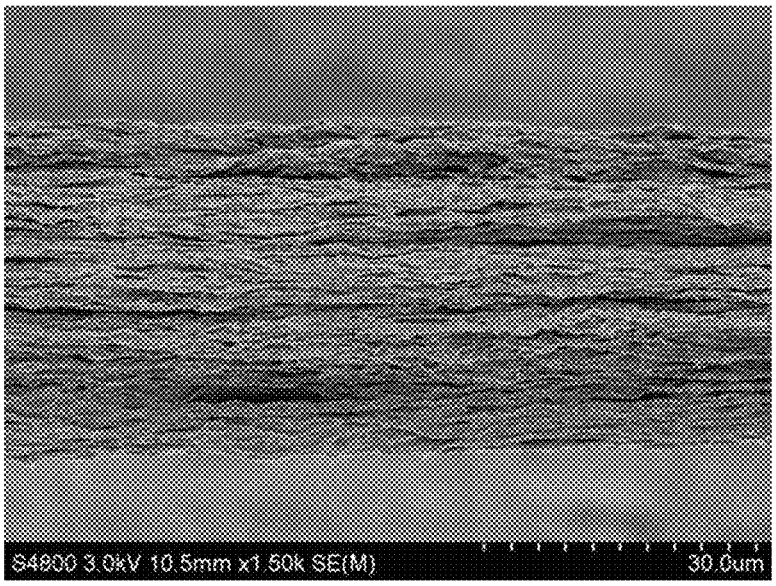
Figure 3:
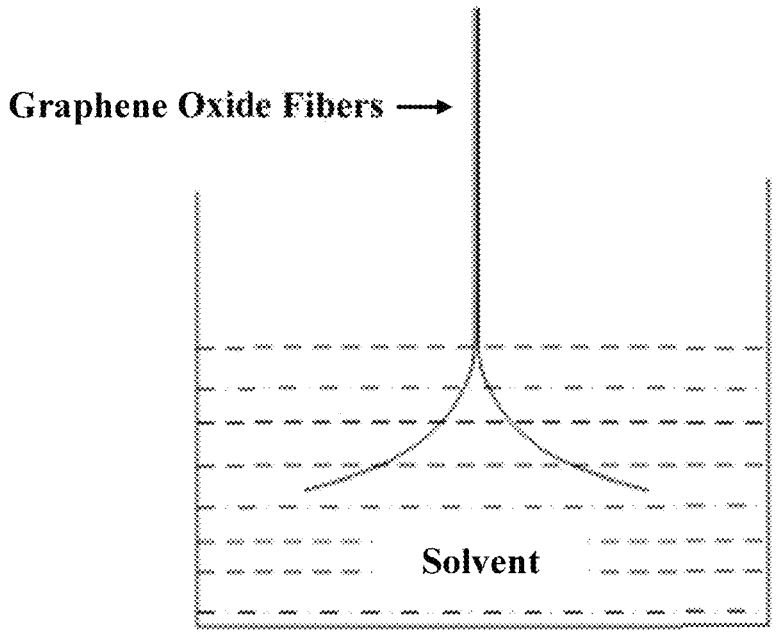
FIG. 3 is a schematic illustration of coalescence of fibers at the surface of a solvent.

The fiber pulling-out method according to the present disclosure may be: clamping one end of a plurality of fibers with a tweezer, and pulling out a plurality of fibers simultaneously, as shown in FIG. 3.

The present disclosure is specifically described by the following embodiments, which are only used to further illustrate the present disclosure but are not intended to be construed as limiting the scope of the present disclosure. Those skilled in the art will make some non-essential changes and adjustments according to the contents of the above present disclosure, while these changes and adjustments are all within the scope of the present disclosure.

Embodiment 1

(1) The graphene oxide fibers were prepared by wet spinning. A solvent of the spinning dope for the graphene oxide fibers was N, N-dimethylformamide and a coagulation bath for the graphene oxide fibers was ethyl acetate.

(2) The graphene oxide fibers were vacuum dried at room temperature for 3 hours.

(3) The fibers obtained in step (2) were soaked in water for 1 minute, so that the fibers were fully infiltrated and swelled.

(4) About 10,000 fibers (metering method) were pulled out simultaneously from the solvent, and the about 10,000 fibers were coalesced at the solvent-air interface under a surface tension of the solvent.

(5) After the coalesced graphene oxide fibers were dried, reduction was performed using hydrazine hydrate.

After the above steps, the multiple graphene fibers were fully fused to form an integral structure. The surface of the fibers had obvious axial grooves which can be used for surface loading. The diameter and mechanical strength of the raw graphene fibers were 20 μm and 203 MPa respectively; after the multiple graphene fibers were fused, the diameter of the self-fused fiber was 1120 μm; an interlayer spacing of constituent graphene sheets was 0.5 to 0.8 nm, and the structure was homogeneous; the conductivity was 285 S/m, and the mechanical strength was 476 MPa.

Embodiment 2

(1) The graphene oxide fibers were prepared by wet spinning. A solvent of the spinning dope for the graphene oxide fibers was water and a coagulation bath for the graphene oxide fibers was an aqueous solution of calcium chloride.

(2) The graphene oxide fibers were vacuum dried at 60° C. for 1 hour.

(3) The fibers obtained in step (2) were soaked in water for 0.1 second, so that the fibers were fully infiltrated and swelled.

(4) 100 fibers were pulled out simultaneously from the solvent, and the 100 fibers were coalesced at the solvent-air interface under a surface tension of the solvent.

(5) After the coalesced graphene oxide fibers were dried, reduction was performed using hydriodic acid.

After the above steps, the 100 graphene fibers were fully fused to form an integral structure. The surface of the fibers had obvious axial grooves which can be used for surface loading. The diameter and mechanical strength of the raw graphene fibers were 12 μm and 280 MPa respectively; after the 100 graphene fibers were fused, the diameter of the self-fused fiber was 176 μm; an interlayer spacing of constituent graphene sheets was 0.7 to 1 nm, and the structure was homogeneous; the conductivity was $1.4\times10^4$ S/m, and the mechanical strength was 292 MPa.

Embodiment 3

(1) The graphene oxide fibers were prepared by dry spinning.

(2) The graphene oxide fibers were vacuum dried at 100° C. for 10 hours.

(3) The fibers obtained in step (2) were soaked in a mixture of water and ethanol (the volume ratio of water to ethanol=3) for 2 hours, so that the fibers were fully infiltrated and swelled.

(4) 4 fibers were pulled out simultaneously from the solvent, and the 4 fibers were coalesced at the solvent-air interface under a surface tension of the solvent.

(5) After coalesced graphene oxide fibers were dried, reduction was performed using sodium borohydride.

After the above steps, the 4 graphene fibers were fully fused to form an integral structure. The surface of the fibers had obvious axial grooves which can be used for surface loading. The diameter and mechanical strength of the raw graphene fibers were 18 μm and 242 MPa respectively; after the 4 graphene fibers were fused, the diameter of the self-fused fiber was 32 μm; an interlayer spacing of constituent graphene sheets was 0.5 to 0.7 nm, and the structure was homogeneous; the conductivity was 448 S/m, and the mechanical strength was 353 MPa.

Embodiment 4

Steps (1)~(2) were the same as those in Embodiment 3.

(3) The fibers obtained in step (2) were soaked in a mixture of water and ethanol (the volume ratio of water to ethanol=1) for 2 hours, so that the fibers were fully infiltrated and swelled.

(4) 8 fibers were pulled out simultaneously from the solvent, and the 8 fibers were coalesced at the solvent-air interface under a surface tension of the solvent.

(5) After the coalesced graphene oxide fibers were dried, thermal reduction was performed at 200° C.

After the above steps, the 8 graphene fibers were fully fused to form an integral structure. The surface of the fibers had obvious axial grooves which can be used for surface loading. The diameter and mechanical strength of the raw graphene fibers were 18 μm and 242 MPa respectively; after the 8 graphene fibers were fused, the diameter of the self-fused fiber was 36 μm; an interlayer spacing of the constituent graphene sheets was 0.6 to 0.8 nm, and the structure was homogeneous; the conductivity was 103 S/m, and the mechanical strength was 326 MPa.

Embodiment 5

Steps (1)~(4) were the same as those in Embodiment 1.

(5) After the self-fused graphene oxide fibers were dried, thermal reduction was performed at 3000° C.

After the above steps, the multiple graphene fibers were fully fused to form an integral structure. The surface of the fibers had obvious axial grooves which can be used for surface loading. The diameter and mechanical strength of the raw graphene fibers were 20 μm and 203 MPa respectively; after the multiple graphene fibers were fused, the diameter of the self-fused fiber was 923 μm; an interlayer spacing of the constituent graphene sheets was 0.8 to 1 nm, and the structure was homogeneous; the conductivity was $1.9\times10^5$ S/m, and the mechanical strength was 289 MPa.

What is claimed is:

1. A method of preparing a self-fused graphene fiber, comprising steps of:

(1) vacuum drying graphene oxide fibers;

(2) soaking the dried fibers in a solvent in such a manner that the fibers are fully infiltrated and swelled;

(3) pulling out two or more fibers simultaneously from the solvent, the fibers being coalesced at a solvent-air interface under a surface tension of the solvent;

(4) performing reduction after the coalesced fibers are dried so as to obtain a self-fused graphene fiber.

2. The method according to claim 1, wherein the graphene oxide fibers in the step (1) are prepared by dry or wet spinning; a solvent of a spinning dope is water, N,N-dimethylformamide, N,N-dimethylacetamide, tetrahydrofuran, dimethyl sulfoxide, N-methyl pyrrolidone, ethylene glycol, diethylene glycol, pyridine, ethyl acetate, dioxane, butanone, or isopropanol; a coagulation bath for the wet spinning is a methanol solution of sodium hydroxide, an ethanol solution of sodium hydroxide, a methanol solution of potassium hydroxide, an ethanol solution of potassium hydroxide, an aqueous solution of sodium hydroxide, an aqueous solution of sodium sulfate, an aqueous solution of sodium chloride, an aqueous solution of calcium chloride, an aqueous solution of sodium nitrate, an aqueous solution of calcium nitrate, an aqueous solution of sodium phosphate, an aqueous solution of potassium chloride, an aqueous solution of ammonium chloride, aqueous ammonia, anhydrous diethyl ether, ethanol, ethyl acetate, acetone, or a mixture of these solutions.

3. The method according to claim 1, wherein a temperature for the vacuum drying in the step (1) is in a range of room temperature to 100° C., and a duration for the vacuum drying in the step (1) is in a range of 1 to 10 hours.

4. The method according to claim 1, wherein the solvent in the step (2) is: water, methanol, ethanol, isopropanol, ethylene glycol, glycerol, diethylene glycol, formic acid, acetic acid, propionic acid, butyric acid, valeric acid, oxalic acid, malonic acid, succinic acid, acrylic acid, acetone, butanone, N,N-dimethylformamide, N,N-dimethylacetamide, tetrahydrofuran, dimethyl sulfoxide, N-methyl pyrrolidone, pyridine, dioxane, an aqueous solution of sodium chloride, an aqueous solution of calcium chloride, an aqueous solution of sodium nitrate, an aqueous solution of calcium nitrate, an aqueous solution of sodium phosphate, an aqueous solution of potassium chloride, an aqueous solution of ammonium chloride, an aqueous solution of potassium hydroxide, an aqueous solution of sodium hydroxide, or a mixture of these solutions.

5. The method according to claim 1, wherein a duration for soaking in the solvent is greater than or equal to 0.1 second.

6. The method according to claim 1, wherein a method for the reduction is a reduction performed using a chemical reducing agent or a thermal reduction at 100 to 3000° C., the chemical reducing agent being selected from a group consisting of hydriodic acid, hydrazine hydrate, vitamin C, and sodium borohydride.

* * * * *